US005821482A

United States Patent [19]

Ootani et al.

[11] Patent Number: 5,821,482

[45] Date of Patent: Oct. 13, 1998

[54] KEYBOARD SWITCH HAVING DUSTPROOF AND DROPLET-PROOF PUSH-BUTTON

[75] Inventors: Yasuo Ootani, Yokohama; Hiroshi Hasegawa, Tokyo; Masao Fukai, Suzaka, all of Japan

[73] Assignee: Fujitsu Takamisawa Component Limited, Tokyo, Japan

[21] Appl. No.: 803,379

[22] Filed: Feb. 20, 1997

[30] Foreign Application Priority Data

Aug. 23, 1996 [JP] Japan ..... 8-222095

[51] Int. Cl.[6] ..... H01H 13/70

[52] U.S. Cl. ..... 200/5 A; 200/341; 200/517

[58] Field of Search ..... 200/5 R, 5 A, 200/512–517, 520, 302.1, 302.2, 341, 345; 400/490, 491, 491.2, 495, 495.1

[56] References Cited

U.S. PATENT DOCUMENTS

| | | | |
|---|---|---|---|
| 3,829,632 | 8/1974 | Klehm, Jr. | 200/5 A |
| 4,596,912 | 6/1986 | Hattori | 200/302.2 |
| 4,806,908 | 2/1989 | Krupnik | 341/22 |
| 5,201,824 | 4/1993 | Kato et al. | 200/520 |
| 5,396,038 | 3/1995 | Yamada | 200/517 |
| 5,448,026 | 9/1995 | Ozeki et al. | 200/5 A |
| 5,456,541 | 10/1995 | Ching-Shui | 400/490 |
| 5,512,722 | 4/1996 | Ozeki et al. | 200/517 |

OTHER PUBLICATIONS

*Patent Abstracts of Japan,* Pub. No. 1–119125, Aug. 11, 1989 (Nippon Denki KK).

*Patent Abstracts of Japan,* Pub. No. 07–114852, May 2, 1995 (Fujitsu Ltd).

*Primary Examiner*—Michael L. Gellner
*Assistant Examiner*—Michael A. Friedhofer

[57] ABSTRACT

A keyboard switch having a dustproof and droplet-proof push-button includes an elastic tube having upper and lower open ends fastened to a slider capped with a keytop and a panel supporting the push-button, respectively, to prevent a dust or droplet of water from being sucked into a space under the slider connecting to an area where pressure sensitive electric switches are located. The elastic tube is collapsible telescopically when the keytop is pushed down, but recovering the original shape by its own elasticity when the pushing force on the keytop is removed. One embodiment of the present invention is one having another elastic member mounted between the slider and one of immobile members, which works predominantly in the final stage of the stroke of the keytop to protect the pressure sensitive electric switch from an excessive impact of tapping.

19 Claims, 7 Drawing Sheets

KEYBOARD SWITCH HAVING DUSTPROOF AND DROPLET-PROOF PUSH-BUTTON

BACKGROUND OF THE INVENTION

1. Field of the Invention

This invention relates to a keyboard switch and a keyboard, particularly to a keyboard switch having dustproof and droplet-proof push-button and a keyboard assembled therewith.

2. Description of the Prior Art

Malfunction of a keyboard used for information processing terminals has recently increased as they are used under such a severe condition that they are operated in a dusty environment or even that they are spilt over by liquid such as coffee or juice. Therefore, a keyboard switch, particularly a push-button, used in recent keyboards must satisfy dustproof and droplet-proof requirements.

FIGS. 1A and 1B are sectional views of a conventional keyboard switch having a dustproof and droplet-proof push-button. The keyboard switch has an upper panel 11 and a lower panel 12 parallel to the upper panel 11, between which a switch sheet 13 having a plurality of switch elements 14 is fixed to the lower panel 12 by an adhesive agent. Each of the switch elements 14 consists of an opposed pair of electrodes with an air gap between them. The push-button is composed of a keytop 15, a slider 16 consisting of a slidertop 19 and a keyshaft 20, a cup rubber 17, and a keyshaft guide 18 standing on the upper panel 11 to guide the keyshaft 20 up and down above the switch element 14. The push-button is arranged above the switch element 14 such that when the keytop 15 is pushed down, the keyshaft 20 squeezes an air gap of the switch sheet 13 to make the pair of electrodes contact to each other, so that the switch element 14 is closed. The cup rubber 17 is composed of an elastic cup having upper and lower openings rimmed with an upper ring flange 21 of a larger diameter and a lower ring flange 22 of a smaller diameter, respectively. The upper ring flange 21 is inserted in an upper groove 23 and the lower ring flange 22 is inserted in a lower groove 24. The cup rubber 17 is stiff enough to suspend the keytop 15 so as to keep a lower end of the keyshaft 20 from the switch sheet 13 and acts as a spring so as to bring back the keytop to the original position after removing a pushing stress from a top 19 of the keytop, and is also intended to act as a dustproof or droplet-proof structure of the push-button by shielding the space inside the cup rubber 17 from the outside environment. As shown in FIG. 1C, the cup rubber 17 has a yielding point in its stress-stroke characteristic curve at which a pushing back force of the push-button disappears suddenly. The snapback action of the push-button is caused by sudden deformation of the elastic cup of the cup rubber.

FIG. 2 is a sectional view of another conventional keyboard switch for a keyboard having a dustproof and droplet-proof push-button. The keyboard has a panel 31, a printed circuit board 32, and a push-button switch 33 mounted on the panel 31. Leads 34 of the push-button switch 33 are sticking out on the back surface of the printed circuit board 32 which are soldered thereto. A keytop 37 is integrally connected with a keyshaft 38 engaged with an upper end of a slider 35 sticking out of the upper panel 31. A hemispherical cup rubber 36 covers both upper parts of the push-button switch 33 and a slider 35 exposed on the upper panel. The keyshaft 38 is engaged into the upper part of the push-button switch 33 and penetrates a top of the cup rubber 36. When the keytop is pressed, the keyshaft 38 can move down along a slider through the hole of the hemispherical cup rubber.

Since, unlike the foregoing example, the hemispherical cup rubber 36 does not have a spring action enough to push up the keytop, the stress-stroke characteristics can be chosen by adjusting a spring assembled in the switch 33. Thus, the dustproof and droplet-proof is implemented to some extent by pressing a lower rim of the hemispherical cup rubber 36 on the upper surface of the panel, particularly when the keytop is pressed. However, the conventional push-button as shown in either FIG. 1A or FIG. 2 is insufficiently in dustproof and droplet-proof because a clearance is easily formed between the lower rim and the panel, and then since a pressure inside the cup rubber becomes negative when the keytop goes back to the original position, dust or droplets are often sucked into the inside of the cup rubber. As shown in FIG. 1B, when the cup rubber 17 is so much deformed by pressing the keytop 15 that such a stress concentrates on the lower ring flange 22 as to pull the lower ring flange 22 outwardly, a clearance is easily formed between the lower ring flange 22 and the lower groove 24. As shown in FIG. 2, since the keyshaft 38 moves up and down through the hole of the hemispherical cup rubber 36, some clearance is always formed between the hole and the keyshaft or between the lower rim of the hemispherical cup rubber 36 and the upper surface of the panel. Eventually, dusts and droplets can be sucked into a space inside the cup rubber 36 when the cup rubber 36 recovers its original shape from deformation. Further, a push-button having a flat or monotonous increase characteristics without a snapback in stress-stroke curve has been recently preferred for the keyboard. However, such a cup rubber as shown in FIG. IA can not satisfy the requirement. These inconvenience and requirements must be solved simultaneously for the advanced keyboard.

SUMMARY OF THE INVENTION

An object of the present invention is to provide a keyboard switch having a dustproof and droplet-proof push-button which has flat or monotonous increase characteristics without a snapback in stress-stroke curve.

Another object of the present invention is to provide a keyboard switch having a dustproof and droplet-proof push-button which has an elastic tube shielding a space inside the elastic tube to prevent a dust and droplets from being sucked into the space from an outside environment.

A further object of the present invention is to provide a keyboard switch having a dustproof and droplet-proof push-button which emits neither a click noise nor an impact resistance at every tapping.

A still further object of the present invention is to provide a keyboard composed of a plurality of keyboard switches having a dustproof and droplet-proof push-button which gives such a soft impact to a switch sheet to avoid impact damage.

BRIEF DESCRIPTION OF THE DRAWINGS

The present invention will be more apparent from the following description, when taken in conjunction with the accompanying drawings, in which.

DESCRIPTION OF THE PREFERRED EMBODIMENTS

Reference will now be made in detail to the preferred illustrated embodiments of the invention, examples of which are illustrated in the accompanying drawings. While the invention will be described in conjunction with the preferred illustrated embodiments, it will be understood that they are not intended to limit the invention to these embodiments. On the contrary, the invention is intended to cover alternatives, modifications and equivalents, which may be included within the spirit and scope of th e invention as defined by the appended claims.

Figure 1A:
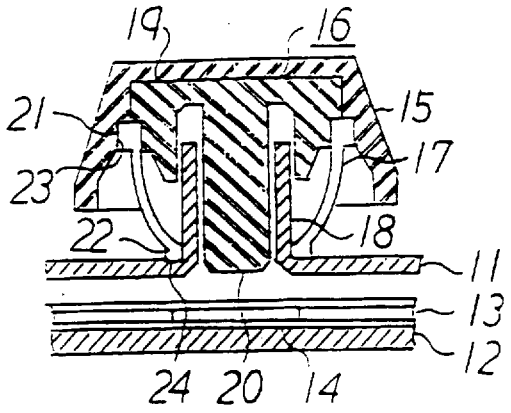
FIG. 1A PRIOR ART
FIGS. 1A and 1B are sectional views of a conventional keyboard switch having a dustproof and droplet-proof push-button when the push-button is released and pushed down, respectively.
Figure 1B:
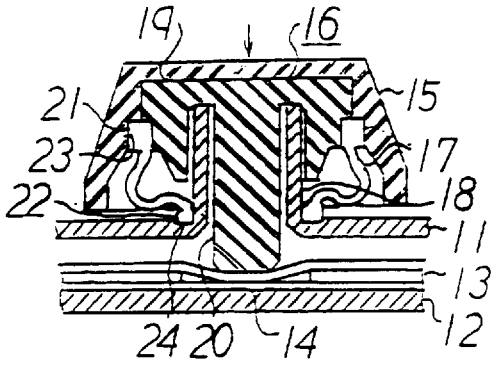
FIG. 1B PRIOR ART
Figure 1C:
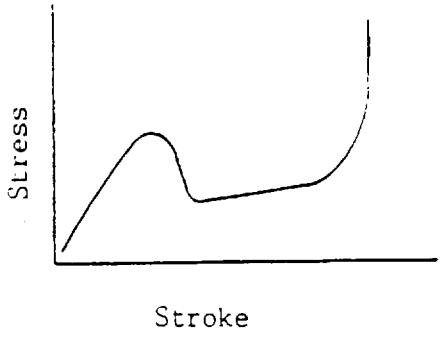
FIG. 1C PRIOR ART
FIG. 1C is a stress-stroke characteristic curve of the conventional dustproof and droplet-proof push-button shown in FIGS. 1A and 1B.
Figure 2:
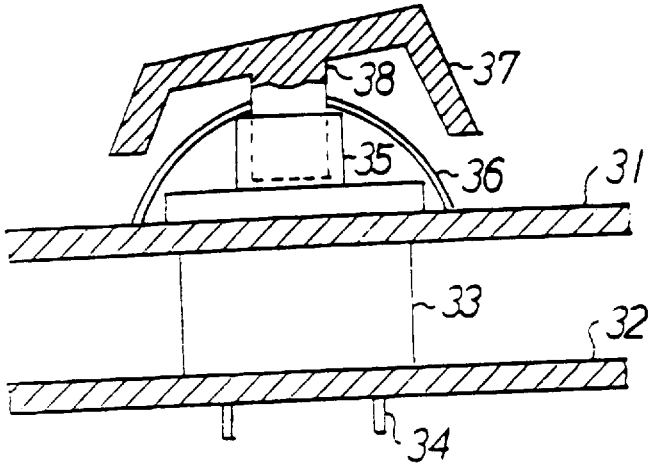
FIG. 2 PRIOR ART
FIG. 2 is a sectional view of another conventional keyboard switch having a dustproof and droplet-proof push-button.
Figure 3:
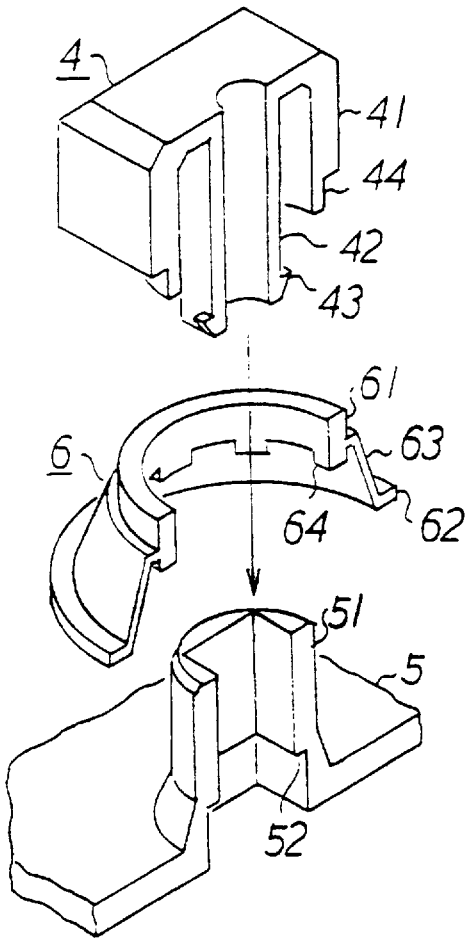
FIG. 3 is an explosive sectional view of a dustproof and droplet-proof push-button used for a keyboard for the first embodiment according to the present invention.

FIG. 3 is an explosive sectional view of a dustproof and droplet-proof push-button used for a keyboard for the first embodiment according to the present invention.

The push-button is composed of a slider 4 having a keytop 41 with a keyshaft 42 extended downward from the keytop 41 and a slider ring 44 around the lower rim of the keytop 41, a slider guide 51 formed on a panel 5 enabling the keyshaft 42 to slide up and down freely through the slide guide 51, and an elastic cup-shaped tube 6, sometimes called a cup rubber, consisting of an upper ring flange 61, a lower ring flange 62 and an elastic cup 63 between the flanges. The upper ring flange 61 is engaged into the slider ring 44 tightly, the cup 63 surrounds the slider guide 51 concentrically and the lower ring flange 62 is constantly pressed to the panel 5 also tightly such that a space inside the elastic cup-shaped tube 6 is shielded air-tightly from the outside environment. A wedge 43 formed at the lower end of the keyshaft 42 and a step 52 formed on the inside surface of the slider guide 51 prevent the keyshaft 42 from coming out of the slider guide 51. Thus, on assembling them together, the keyshaft 42 is inserted into the slider guide 51 until the wedge 43 is latched on the step 52, the slider ring 44 is inserted into the upper ring flange 61 tightly, and the lower ring flange 62 is pressed also tightly to the panel 5 such that the elastic cup-shaped tube 6 surrounds the slider guide 51. Since a diameter of the upper ring flange 61 is smaller than that of the lower ring flange 62, and the elastic cup-shaped tube 6 is monolithic, the cup 63 is flaring out downward. The stiffness and height of the cup 63 is selected such that the slider 4 is suspended above the upper end of the slider guide 51 only by a repulsive force of the elastic cup-shaped tube or the cup rubber 6 when the keytop is not pressed, as described in detail later.

Figure 4A:
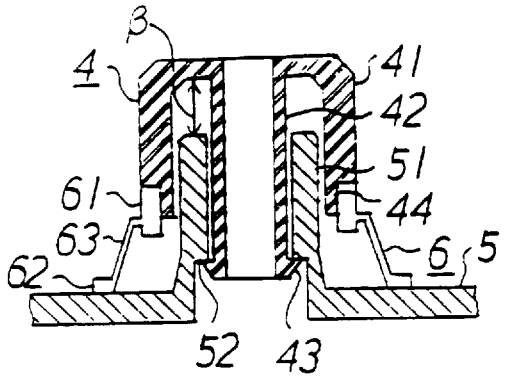
FIGS. 4A and 4B are sectional views of a dustproof and droplet-proof push-button shown in FIG. 3 when the push-button is released and pushed down, respectively.
Figure 4B:
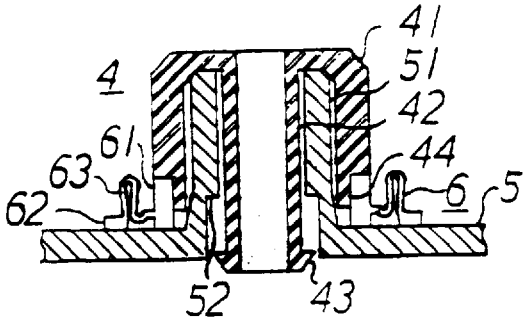

FIGS. 4A and 4B are sectional views of a dustproof and droplet-proof push-button shown in FIG. 3 when the push-button is released and pushed down, respectively.

Figure 4C:
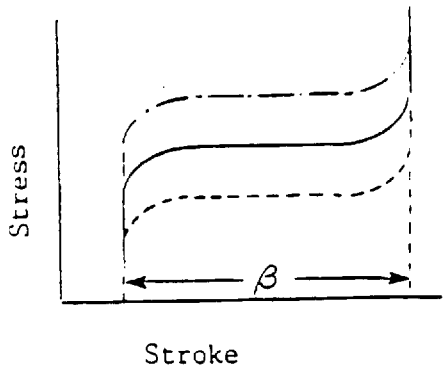
FIG. 4C is a stress-stroke characteristic curve of the dustproof and droplet-proof push-button shown in FIGS. 4A and 4B.

The maximum stroke of the push-button is determined by a distance $\beta$ between a back surface of the keytop 41 and the upper end of the slider guide 51. However, as a practical matter, when the slider 4 is pushed down as shown in FIG. 4B, it can be adjusted such that the bottom of the upper flange 61 touches the top of the slider guide 51 before the back surface of the keytop 41 touches the upper end of the slider guide 51, which is favored to a quiescent touch sound. If the keytop 41 is tapped strongly, the elastic upper flange 61 is compressed until the back surface of the keytop 41 hits the upper end of the slider guide 51. Since the cup is already slightly deformed downward by $\alpha$ due to a weight of the slider 4 under the situation shown in FIG. 4A, a distance $H_1$ between the lower end on the outer periphery of the keytop 41 and the surface of the panel 5 is chosen such that the height $H_2$ of the cup in weight free is equal to $H_1+\alpha$, where $\alpha$ is adjustable by choosing stiffness of the cup material. FIG. 4C is a stress-stroke characteristic curve of the dustproof and droplet-proof push-button shown in FIGS. 4A and 4B. The upper, middle, and lower curves correspond to cups which are higher, middle and lower in stiffness, respectively. The initial rise of each curve shows deformation by the weight of the keytop 41, while the almost horizontal shift in stroke shows large deformation of the thin cup by a small stress. On the other hand, the last sharp rise of each curve indicates the compression of the upper flange 61. If a clear tapping sound is preferred for the keyboard,it can be easily done by adjusting the height and/or stiffness of the elastic upper flange 61 such that the back surface of the keytop 41 hits the upper end of the slider guide 51 at every normal tapping. Since the cup 63 is thinner than the flanges 61 and 62, there is, as a practical matter, no deformation in the flanges 61 and 62 breaks the air tight seal even for a large deformation of the cup 63. Therefore,dust or a droplet of water are prevented from infiltrating into the inside of the switch area.

Figure 5A:
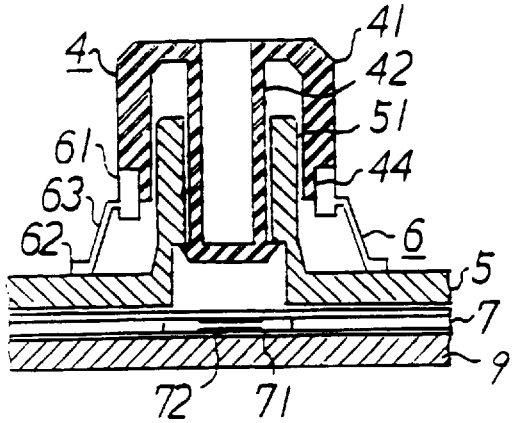
FIGS. 5A and 5B are sectional views of a keyboard having the dustproof and droplet-proof push-button shown in FIG. 3 for the second embodiment according to the present invention when the push-button is released and pushed down, respectively.
Figure 5B:
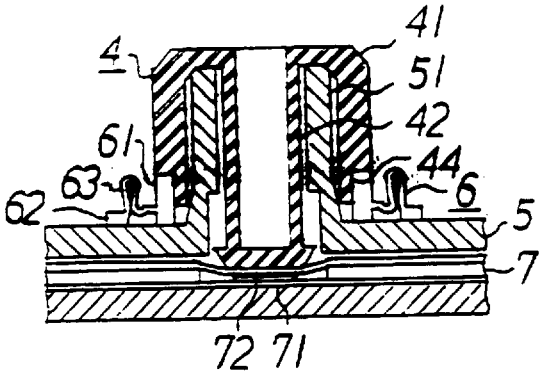

FIGS. 5A and 5B are sectional views of a keyboard having the dustproof and droplet-proof push-button shown in FIG. 3 for the second embodiment according to the present invention when the push-button is released and pushed down, respectively.

The keyboard for the second embodiment according to the present invention is composed of an array of the dustproof and droplet-proof push-buttons shown in FIG. 4A and the switch sheet 7 between the panel 5 and the lower panel 9 as shown in FIG. 5A, in which an electric switch 71 in the switch sheet 7 is positioned beneath the keyshaft 42. As shown in FIGS. 5A and 5B, the slider 4 is pressed down to the end, the keyshaft pushes the switch sheet such that a pair of electrodes 72 contact to each other to make the electric switch closed, and when the push-button is released, the keyshaft 42 returns to the original position by elasticity of the cup 63 and then the pair of electrodes 72 separate from each other by elasticity of the switch sheet to make the switch open. If the back surface of the keytop 41 hits against the upper end of the slider guide 51 at every tapping, it accelerates an operator's fatigue due to a mechanical impact propagating to the operator's fingers as well as a noisy sound. To avoid these unfavorable effects, an upper flange of the cup rubber has a plurality of prominence or projections 64 on the lower rim as shown in FIG. 3 which extend inside the cup 6. The prominence hits the surface of the panel 5 before the back surface of the keytop 41 hits against the upper end of the slider guide 51, which result in killing the noisy sound and the mechanical impact propagating to the operator's fingers. Another effect of the prominence is to prevent the space in the buckling cup from being isolated when the lower end of the upper flange 61 touches the panel 5.

Figure 6A:
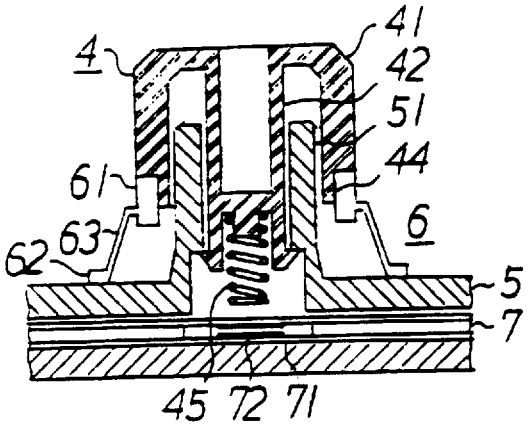
FIGS. 6A and 6B are sectional views of a keyboard having a dustproof and droplet-proof push-button for the third embodiment according to the present invention when the push-button is released and pushed down, respectively.
Figure 6B:
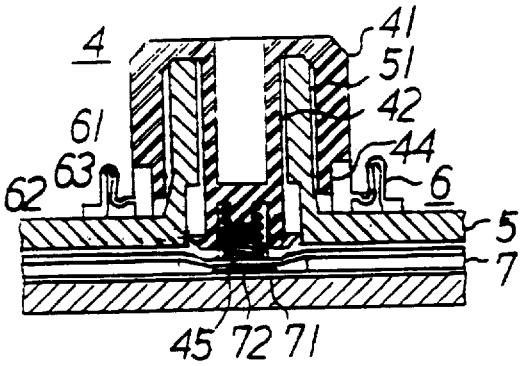

FIGS. 6A and 6B are sectional views of a keyboard having a dustproof and droplet-proof push-button for the third embodiment according to the present invention when the push-button is released and pushed down, respectively.

Figure 6C:
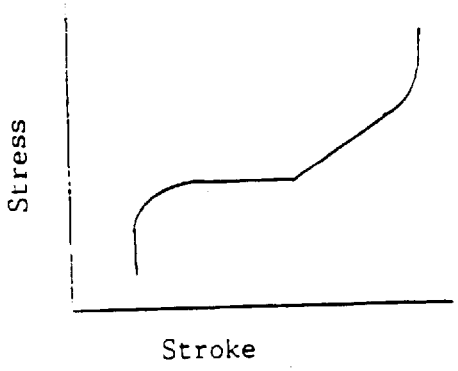
FIG. 6C is a stress-stroke characteristic curve of the dustproof and droplet-proof push-button shown in FIGS. 6A and 6B.

The keyboard in the third embodiment has a coil spring 45 fixed to a lower part of the keyshaft 42. As shown in FIGS. 6A and 6B, the free end of the coil spring 45 is positioned above the switch sheet 7 when the push-button is released. When the push-button is pressed, the free end of the coil spring 45 pushes against the switch sheet 7 such that the electric switch 71 is closed by contacting a pair of the electrodes 72 to each other. As shown in FIG. 6C, the stress-stroke characteristic curve indicates a gradual increase in stress before the maximum stroke due to superimposing the characteristic curve of the coil spring to that of the cup rubber 6. In other words, only a repulsive force by the cup rubber 6 is worked at the beginning until the free end of the coil spring 45 touches the switch sheet 7, and afterward, a repulsive force of the coil spring becomes predominant. The gradual increase of the characteristic curve is favorable to avoid damaging a switch sheet by an excessive impact of the keyshaft as well as to avoid the impact noise. This flat-and-gradual increase of the characteristic curve would be obtained by any other locations of the spring if the spring would be properly fitted between a mobile member of the keyboard such as the keytop or keyshaft and an immobile member such as the panel, slider guide, or switch sheet.

Figure 7:
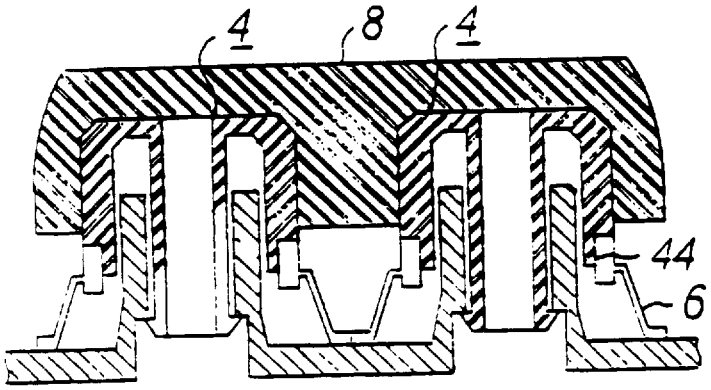
FIG. 7 is a sectional view of a dustproof and droplet-proof push-button having a stretched keytop used for a keyboard for the fourth embodiment according to the present invention.

FIG. 7 is a sectional view of a dustproof and droplet-proof push-button having a stretched keytop used for a keyboard for the fourth embodiment according to the present invention.

Each of keytops arranged on a keyboard on which a letter or symbol is labeled is generally capped on a single slider. However, some keytop having a special function, such as the shiftkey, is stretched over a plurality of sliders. If the stretched keytop is simply capped on a plurality of sliders having the same stress-stroke characteristics as that of a slider capped on by a single keytop, a force needed to press down the stretched keytop will be multiplied by a number of the capped sliders. The stretched keytop 8 on a keyboard for the fourth embodiment according to the present invention is capped on two sliders 4 as shown in FIG. 7, each of which is supported by a respective cup rubber 6 having an engaged upper flange 44. However, the total stress-stroke characteristics is equalized to that of a single slider. As described before, this can be easily done by selecting stiffness of the cup rubbers 6. This principle is also applied to a stretched keytop over sliders having springs. Namely, a spring constant of each spring under a stretched keytop should be equal to a value which is given by dividing the spring constant of the spring for a single slider by the number of the springs under the stretched keytop.

Thus, as described above, the essential feature of the push-button for the keyboard according to the present invention is an elastic tube, not limited to cup-shaped, for covering a space around the slider guide between the slider and the upper surface of the panel, which can be collapsed when the keytop is pushed down, the elastic tube having upper and lower open ends both being fastened, namely not limited to engaged and pressed but also grasped or adhered, to an outer rim of the lower surface of the slider and to the upper surface of the panel so tightly, respectively as to prevent air outside the elastic tube from being sucked into the space. Therefore, a space inside the elastic tube is shielded completely from the outside environment, which eventually prevents a dust or a droplet of water from infiltrating into the inside of the switch area.

Another essential feature is that the push-button has a plurality of elastic members; a first elastic member for suspending the slider at such a height from the upper surface of the panel by opposing a gravitational force working on the slider capped by the keytop that the lower end of the shaft is held above the corresponding one of the pressure-sensitive electric switches in the switch sheet when the pushing force on the keytop is removed; and a second elastic member for preventing the lower end of the shaft from giving an excessive impact to the pressure sensitive electric switch by being arranged between the slider and an immobile member in the push-button, wherein the immobile member is the guide, the panel, or the switch sheet such that the second elastic member is squeezed between the slider and the immobile member before the lower end of the shaft gives an excessive impact to the pressure sensitive electric switch due to direct propagation of the pushing force when the keytop would be pushed down strongly. For this purpose, the elastic constant of the first elastic member is selected to be smaller than that of the second elastic member, and that the first elastic member works in all range of the stroke of the keytop, while the second elastic member works predominantly over the first elastic member immediately before the lower end of the shaft presses the pressure sensitive electric switch. It should be noticed that the first elastic member is not limited to be the cup itself, but it can be another elastic member other than the cup wherein the cup does need to have its own elasticity. Consequently, it gives rise to a slow increase, even nearly horizontal shift in the initial stage and a rapid increase in the final stage of the stress-stroke characteristic curve.

What is claimed is:

1. A keyboard switch having a push-button comprising:

a keytop having a front surface and a back surface opposite to the front surface for closing the keyboard switch by pushing on the front surface;

a slider having an upper surface, a lower surface opposite to the upper surface, and a shaft extended downward from the lower surface, in which the upper surface is capped tightly by the back surface of the keytop, the slider for propagating a pushing force from the keytop to the shaft;

a guide for allowing the shaft to move up and down only along one direction by sliding with respect to each other;

a panel having an upper surface and a lower surface opposite to the upper surface, for supporting the guide perpendicularly on the upper surface of the panel, the panel having a through hole through which the shaft moves up and down;

a tube covering the guide, having an upper ring flange, a lower ring flange having a diameter which is larger than that of the upper ring flange, and an elastic cup having upper and lower open ends gaplessly rimmed with the upper and lower ring flanges, respectively, the upper ring flange engaged tightly with an outer rim of the lower surface of the slider, the lower ring flange laid down on the upper surface of the panel tightly by pressing the upper surface of the panel constantly, and the elastic cup being deformed when the upper ring flange moves down toward the upper surface of the panel by pushing the keytop down, and recovering its original shape by its own elasticity so as to return the upper ring flange to an initial position when the pushing force on the keytop is removed, the tube for suspending the slider at such a height from the upper surface of the panel by opposing a gravitational force working on the slider capped by the keytop that the keyboard switch is maintained in an open state when the pushing force on the keytop is removed;

a switch sheet having a pressure-sensitive electric switch therein which is located below the panel such that a lower end of the shaft comes down through the through hole to press the pressure-sensitive electric switch to be closed when the keytop is pushed down; and a second elastic member, in addition to the elastic cup of the tube, arranged between the slider and an immobile member in the push-button, wherein the immobile member is the guide, the panel, or the switch sheet such that the second elastic member is squeezed between the slider and the immobile member before the lower end of the shaft gives an excessive impact to the keyboard switch due to direct propagation of the pushing force when the keytop is pushed down strongly and wherein the second elastic member is gaplessly continuous to the tube.

2. A keyboard switch having a push-button according to claim 1, wherein the second elastic member is an array of prominent parts extended downward arranged symmetrically around the shaft on the upper ring flange such that each of the prominent parts hits the upper surface of the panel at tapping of the keytop.

3. A keyboard switch having a push-button according to claim 1, wherein the second elastic member is symmetrically extended from the upper ring flange to a vicinity of the shaft in a radial directions such that the elastic member is squeezed between the slider and an upper surface of the guide at tapping of the keytop.

4. A keyboard switch having a push-button according to claim 1, wherein the elastic cup has a monotonous increase in stress as increase of stroke of the keytop by an external force on the keytop.

5. A keyboard switch having a push-button according to claim 1, wherein the second elastic member has an elastic constant different from that of the elastic cup.

6. A keyboard switch having a push-button according to claim 5, wherein the elastic constant of the second elastic member is larger than that of the elastic cup.

7. A keyboard switch having a push-button according to claim 1, wherein stress-stroke characteristics of the second elastic member are superimposed on stress-stroke characteristics of the elastic cup.

8. A keyboard switch having a push-button according to claim 7, wherein the second elastic member is predominant over the elastic cup in the stress-stroke characteristics at a final stage of the stroke of the keytop.

9. A keyboard switch having a push-button according to claim 1, wherein the second elastic member is a coil spring an upper end of which is fixed on the lower end of the shaft such that the coil spring is compressed before a lower end of the coil spring presses an upper surface of the pressure sensitive electric switch strongly enough to close the keyboard switch.

10. A keyboard switch having a push-button according to claim 1, wherein a plurality of the sliders are capped with a single stretched keytop, each of which has a repulsive mechanism of an identical elastic constant in stress-stroke characteristics which is given by dividing an elastic constant in stress-stroke characteristics of a single slider capped with a single keytop by the total number of the sliders under the stretched keytop.

11. A keyboard switch having a push-button according to claim 1, further comprising:

a wedge sticking out at a lower end of the shaft; and a step formed on the guide for preventing the shaft from coming out of the guide when the slider rebounds upward excessively by elasticity of the tube or second elastic member after the pushing force on the keytop is removed, wherein when the keyboard switch is assembled, the shaft is inserted into the guide until the wedge is latched on the step.

12. A keyboard switch having a push-button according to claim 1, wherein the tube is collapsed in height by telescoping itself when the slider moves down when the keytop is pushed down.

13. A keyboard comprising:

an array of push buttons, an upper panel having an upper surface, a lower surface opposite to the upper surface, and an array of through holes, the upper panel for supporting the array of push buttons perpendicularly on the upper surfaces each push button being arranged above one of the through holes;

a lower panel having a front surface and a back surface, which is located below the upper panel; and a switch sheet having an array of pressure sensitive electric switches therein, wherein the switch sheet is laid down on the front surface of the lower panel such that each of the pressure sensitive electric switches is arranged under the corresponding through hole of the upper panel, wherein each of the push-buttons comprises:

a keytop having a front surface and a back surface opposite to the front surface for closing the pressure sensitive electric switches by pushing on the front surface;

a slider having an upper surface, a lower surface opposite to the upper surface, and a shaft extended downward from the lower surface, in which the upper surface is capped tightly by the back surface of the keytop, the slider for propagating a pushing force from the keytop to the shaft;

a guide for allowing the shaft to move up and down only along one direction by sliding with respect to each other, in which the guide is supported perpendicularly on the upper surface of the upper panel, such that the shaft moves up and down through the through hole;

a tube for covering a space around the guide between the slider and the upper surface of the upper panel, which can be deformed when the keytop is pushed down, the tube having upper and lower open ends which are fastened to an outer rim of the lower surface of the slider and to the upper surface of the upper panel so tightly, respectively as to prevent air outside the tube from being sucked into the space, said tube including a first elastic member for suspending the slider at such a height from the upper surface of the upper panel by opposing a gravitational force working on the slider capped by the keytop that the lower end of the shaft is held above the pressure-sensitive electric switch under the through hole when the pushing force on the keytop is removed; and a second elastic member arranged between the slider and an immobile member for preventing the lower end of the shaft from giving an excessive impact to the pressure sensitive electric switch, wherein the immobile member is the guide, the upper panel, or the switch sheet, such that the second elastic member is squeezed between the slider and the immobile member before the lower end of the shaft gives an excessive impact to the pressure sensitive electric switch due to direct propagation of the pushing force when the keytop is pushed down strongly and wherein the elastic constant of the first elastic member is smaller than that of the second elastic member.

14. A keyboard according to claim 13, wherein the first elastic member works in an overall range of the stroke of the keytop, while the second elastic member works predominantly over the first elastic member immediately before the lower end of the shaft presses the pressure sensitive electric switch.

15. A keyboard according to claim 13, wherein the second elastic member is a coil spring.

16. A keyboard according to claim 15, wherein an upper end of the coil spring is fixed on the lower end of the shaft such that the coil spring is compressed before a lower end of the coil spring presses an upper surface of the switch sheet strongly enough to close the pressure sensitive electric switch thereunder.

17. A keyboard switch having a push-button comprising:

a keytop having a front surface and a back surface opposite to the front surface for closing the keyboard switch by pushing on the front surface;

a slider having an upper surface, a lower surface opposite to the upper surface, and a shaft extended downward from the lower surface, in which the upper surface is capped tightly by the back surface of the keytop, the slider for propagating a pushing force from the keytop to the shaft;

a guide for allowing the shaft to move up and down only along one direction by sliding with respect to each other;

a panel having an upper surface and a lower surface opposite to the upper surface, for supporting the guide perpendicularly on the upper surface of the panel, the panel having a through hole through which the shaft moves up and down;

a tube covering the guide, having an upper ring flange, a lower ring flange having a diameter which is larger than that of the upper ring flange, and an elastic cup having upper and lower open ends gaplessly rimmed with the upper and lower ring flanges, respectively, the upper ring flange engaged tightly with an outer rim of the lower surface of the slider, the lower ring flange laid down on the upper surface of the panel tightly by pressing the upper surface of the panel constantly, and the elastic cup being deformed when the upper ring flange moves down toward the upper surface of the panel by pushing the keytop down, and recovering its original shape by its own elasticity so as to return the upper ring flange to an initial position when the pushing force on the keytop is removed, the tube for suspending the slider at such a height from the upper surface of the panel by opposing a gravitational force working on the slider capped by the keytop that the keyboard switch is maintained in an open state when the pushing force on the keytop is removed;

a switch sheet having a pressure-sensitive electric switch therein which is located below the panel such that a lower end of the shaft comes down through the through hole to press the pressure-sensitive electric switch to be closed when the keytop is pushed down; and a second elastic member, in addition to the elastic cup of the tube, arranged between the slider and an immobile member in the push-button, wherein the immobile member is the guide, the panel, or the switch sheet such that the second elastic member is squeezed between the slider and the immobile member before the lower end of the shaft gives excessive impact to the keyboard switch due to direct propagation of the pushing force when the keytop is pushed down strongly;

wherein the second elastic member has an elastic constant which is larger that of the elastic cup.

18. A keyboard switch having a push-button comprising:

a keytop;

a slider having a shaft extended downward from said keytop, the slider for propagating a pushing force from the keytop to the shaft;

a guide which allows the shaft to move up and down;

a panel having a through hole through which the shaft moves up and down;

a tube covering the guide and having a first elastic member which is deformed when said keytop is pushed down and which recovers its original shape by its own elasticity when the pushing force on said keytop is removed, said tube suspending the slider above said panel by opposing a gravitational force working on said slider, so that said keyboard switch is maintained in an open state when the pushing force on the keytop is removed;

a switch sheet located below said panel such that said shaft extends through the through hole to press said switch sheet when the keytop is pushed down;

a second elastic member arranged between said slider and an immobile member in said push-button, which is formed by said guide, said panel, or said switch sheet, so that said second elastic member is squeezed between said slider and said immobile member, said second elastic member being gaplessly continuous to said tube.

19. A keyboard switch having a push-button comprising:

a keytop;

a slider having a shaft extended downward from said keytop, the slider for propagating a pushing force from the keytop to the shaft;

a guide which allows the shaft to move up and down;

a panel having a through hole through which the shaft moves up and down;

a tube covering the guide and having a first elastic member which is deformed when said keytop is pushed down and which recovers its original shape by its own elasticity when the pushing force on said keytop is removed, said tube suspending the slider above said panel by opposing a gravitational force working on said slider, so that said keyboard switch is maintained in an open state when the pushing force on the keytop is removed;

a switch sheet located below said panel such that said shaft extends through the through hole to press said switch sheet when the keytop is pushed down;

a second elastic member arranged between said slider and an immobile member in said push-button which is formed by said guide, said panel, or said switch sheet, so that said second elastic member is squeezed between said slider and said immobile member, said first elastic member having an elastic constant which is smaller than the elastic constant of the second elastic member.

* * * * *

UNITED STATES PATENT AND TRADEMARK OFFICE

CERTIFICATE OF CORRECTION

PATENT NO.: 5,821,482
DATED : October 13, 1998
INVENTOR(S): Yasuo OOTANI et al.

It is certified that error appears in the above-identified patent and that said Letters Patent is hereby corrected as shown below:

Col. 2, line 9, delete "in";
line 42, delete "a".

Col. 3, line 38, change "th e" to --the--.

Col. 4, line 36, change "keyboard,it" to --keyboard, it--;
line 43, change "Therefore,dust" to --Therefore, dust--.

Col. 6, line 11, delete "a".

Col. 7, line 41, change "directions" to --direction,--.

Col. 8, line 29, change "surfaces" to --surface,--.

Signed and Sealed this

Second Day of March, 1999

*Attest:*

Q. TODD DICKINSON

*Attesting Officer*

*Acting Commissioner of Patents and Trademarks*